United States Patent [19]

Berman

[11] 4,221,086

[45] Sep. 9, 1980

[54] BANKING PROTECTION SYSTEM FOR 24 HOUR BANKING

[75] Inventor: James S. Berman, New York, N.Y.

[73] Assignee: Citibank, N.A., New York, N.Y.

[21] Appl. No.: 943,219

[22] Filed: Sep. 18, 1978

Related U.S. Application Data

[62] Division of Ser. No. 875,915, Feb. 7, 1978.

[51] Int. Cl.[2] ..... E04B 1/346

[52] U.S. Cl. ..... 52/65; 52/239; 52/71; 160/135

[58] Field of Search ..... 52/65, 70, 71, 239, 52/240, 238, 243; 160/135, 351; 248/356, 644

[56] References Cited

U.S. PATENT DOCUMENTS

| | | | |
|---|---|---|---|
| 2,311,951 | 2/1943 | Marshall | 52/243 |
| 4,037,385 | 7/1977 | Wahlquist | 52/71 X |
| 4,129,163 | 12/1978 | Johnson | 52/239 X |

*Primary Examiner*—Price C. Faw, Jr.
*Assistant Examiner*—Carl D. Friedman
*Attorney, Agent, or Firm*—Morgan, Finnegan, Pine, Foley & Lee

[57] ABSTRACT

Credit card operated, automated teller machines are located in the vestibule of a bank where they may be accessed during normal banking hours. During off hours, a partition system segregates the vestibule from the remainder of the bank. Off-hour access to the vestibule is advantageously controlled by a customer activated door lock operated by the credit card and reader located at the bank door. Thus, access to the vestibule and the automated teller machines are controlled by the customer own credit card.

3 Claims, 17 Drawing Figures

BANKING PROTECTION SYSTEM FOR 24 HOUR BANKING

This is a division of application Ser. No. 875,915 filed Feb. 7, 1978.

BACKGROUND

This invention relates to the banking field and more particularly to the field of electronic funds transfer and customer improvements. More particularly, this invention relates to a protection system which enables customers to access their bank accounts and transact business at any time while providing a customer accessed security area during non-banking hours.

Within the banking industry, a rapid growth of electronic funds transfer technology has resulted in the development of a variety of credit card systems and peripheral equipment. While the specifics of each system vary, their basic structure and function is to provide credit card access to data bases and operational software to allow inquiries to and transactions with a customer's account.

Typical examples of these systems are disclosed in Travioli, Pat. No. Re. 28,081 and Scantlin, U.S. Pat. Nos. 3,775,755; 3,802,101; and 3,819,910, which disclose coded card structure, and methods of coding and reading information from the cards.

In order to decrease the manpower and paper requirements associated with banking transactions, a variety of automated teller machines (ATM) have been developed in the industry. ATM's are made by a variety of manufacturers including NCR Corporation, Transaction Technology, Inc. and Docutel Corp.

While ATM's have achieved some measure of success in increasing the service to banking customers, their full potential has not been fully realized. On the one hand, limiting access to ATM during banking hours limits the service to the customer since no access can be had during off hours. On the other hand, locating ATM's where there is unlimited access, e.g. outside the bank proper, does increase the access time, but customers are hesitant to use the ATM's for a variety of reasons including privacy and security.

SUMMARY OF THE INVENTION

The present invention is directed to a banking protection system wherein ATM's are locked in a bank but are accessible 24 hours a day by the customer.

To this end, the ATM is located near the entrance to the bank and in the banking area. A partition system segregates the ATM from the remainder of the bank during off hours and allows access to the ATM through the entrance. During normal banking hours the partition system is open.

Advantageously, an electronic lock and customer card reader is used to limit access to the bank during off hours so that only bank customers with valid cards may enter.

Thus, the present invention may be summarized in its broadest concept as:

A banking protection system for providing 24 hour service to customers comprising: an enclosed banking area having an entrance, partition means located in said banking area to divide said banking area in a vestibule area adjacent said entrance and a second banking area remote from said entrance, said partition means being movable between a closed position, wherein said partition means block access to said second banking area, and an open position; automated teller machine means located in said vestibule customer area, whereby said customer may enter the vestibule customer area during off hours when said partition means are in said closed position to use the automated teller machine means.

DETAILED DESCRIPTION

Figure 1:
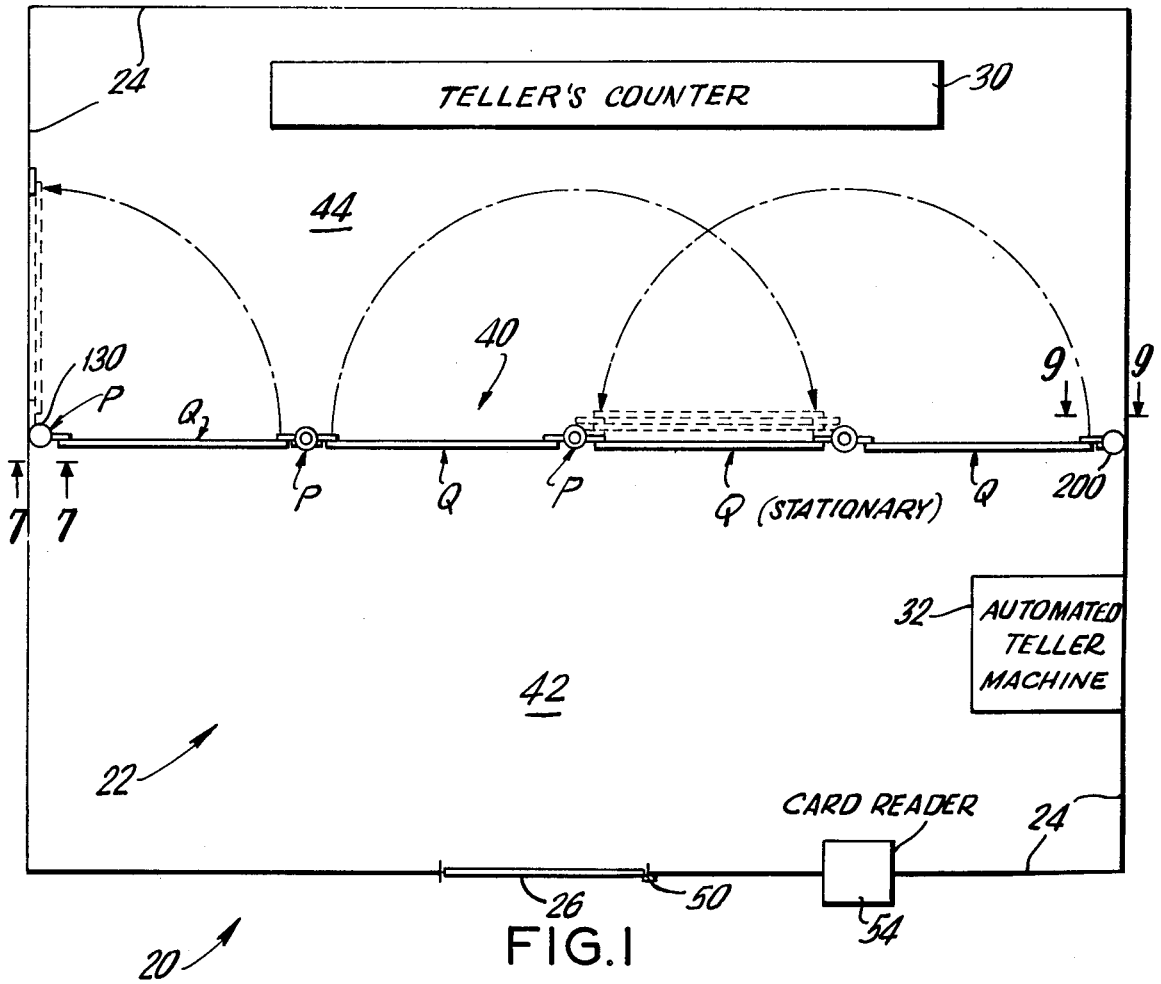
FIG. 1 is a plan view of a banking protection system according to the present invention illustrated as installed in a bank with the partitions shown in the closed position during off-hour banking.

While this invention is susceptible of embodiment in many different forms, there is shown in the drawings and will hereinafter be described in detail a preferred embodiment of the invention, and modifications thereto, with the understanding that the present disclosure is to be considered as an exemplification of the principles of the invention and is not intended to limit the invention to the embodiments illustrated.

FIG. 1 shows a typical bank 20 equipped with the banking protection system of the present invention. Bank 20 is illustrative only, and it will be appreciated that other configurations are also adaptable for use with the present invention.

Bank 20 includes an enclosed banking area 22 as by wall 24 which is provided with a front entrance 26 through which customers enter the bank. Within the bank at an area remote from the door 26 are the teller's counter 30 and such other service areas normally found in the bank, such as officer's area, information desk, vault safety deposit boxes, etc. (not shown). The bank also includes at least one automated teller machine 32 (ATM) which is customer activated by means of an identification card having indicia for electronic authorization and funds transfer. ATM's and the credit cards which activate them are well known in the industry, examples of which may be found in the patents referred to above.

The ATM 32 is located in close proximity to the entrance 26 so that customers may gain quick access thereto. As illustrated, the ATM is located against or in one wall of the bank. However, the ATM 32 may be located in the open area of the bank as well.

The banking area 22 is divided by means of a partition system 40 into a vestibule 42 between the entrance 26 and the partition and the remainder 44 of the banking area. The partition system 40 is shown in the closed and locked position in solid line in FIG. 1 wherein customer access is limited to the vestibule area. As explained in greater detail below, the partition system is open (as shown in dotted line) during normal banking hours to allow free customer movement throughout the bank.

The ATM is the only active device located within the vestibule area 42. Thus when partition system 40 is closed and locked, customers have access to ATM but not the other areas of the bank.

The use of the partition system increases not only the utility and service of the bank to its customers during off hours by providing access to their accounts through the ATM, but also negates the need for duplication of ATM's. Prior to the present invention, one set of ATM's would be used in the bank during normal banking hours and another ATM would be outside the bank for use during non-banking hours.

The partition system may be used with the entrance 26 unlocked during non-banking hours, but it is preferred that the entrance 26 be provided with a locking mechanism to limit access to the vestibule. To this end, an electronic locking mechanism 50 is provided. A solenoid activated door latch or other similar device is satisfactory. Locking mechanism 50 is operated by the central processor unit 52 which sends a signal to operate the device.

Activation of the locking mechanism is achieved by means of a card reader 54 which is located adjacent the entrance. Reader 54 is the same type which is used in the ATM 32 to produce identification of the customer.

Thus, the customer's bank card acts as the "key" to unlock the bank entrance and the customer's account. Use of an electronic pass helps to assure that only bank customers having valid cards are admitted to the vestibule during off hours.

During off hours when partition system 40 is closed as shown in solid line in FIG. 1, operation of the system is as follows. A customer approaches the front door 26 and inserts his bank card into reader 54. The card is read and the C.P.U. 52 is queried to see that the card is valid. If valid, the C.P.U. 52 sends a signal to locking device 50 to unlock the door momentarily to allow the customer to enter vestibule 42. A pulse of a few seconds to a solenoid operated catch is sufficient. The customer opens the door and enters the vestibule to transact his business through the ATM 32. The customer may unlock the door 26 from the inside to leave and the door locks automatically when it closes. C.P.U. 52 is advantageously the same as the control for the ATM 32. However, a separate control may be used.

During normal banking hours the partition system is open as shown in dotted line in FIG. 1 and the entrance 26 is unlocked. Customer usage of the ATM 32 is the same.

Partition system 40 is formed by a series of poles P which carry or lock panels Q which extend from floor to ceiling. Several different configurations of poles are used to allow flexibility in design and openness when the partition system is in the open position.

Figure 2:
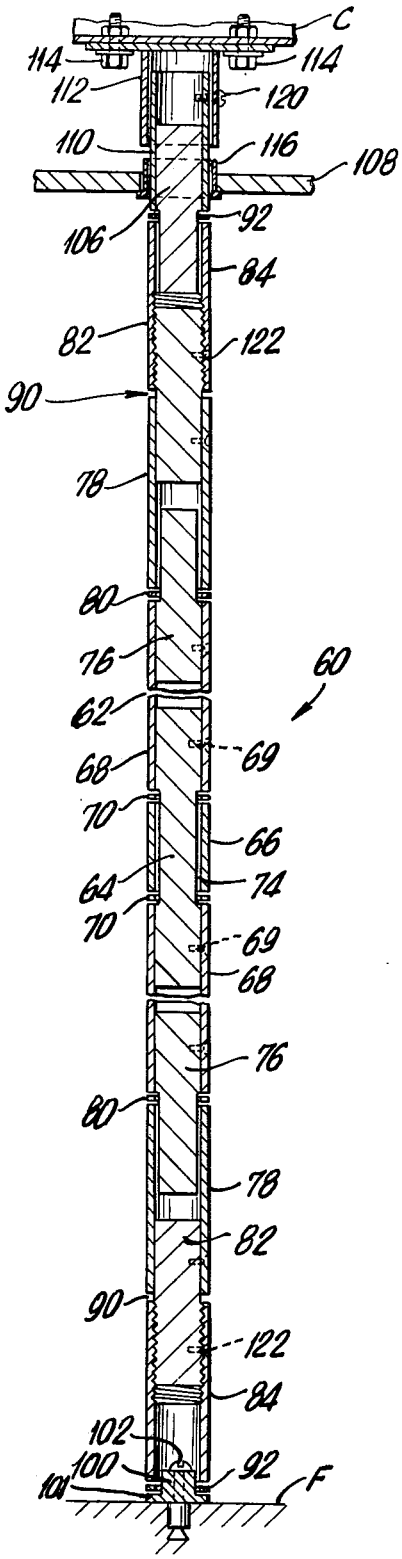
FIG. 2 is a longitudinal cross-sectional view taken generally along line 2—2 in FIG. 3 of a support pole for the partition.
Figure 3:
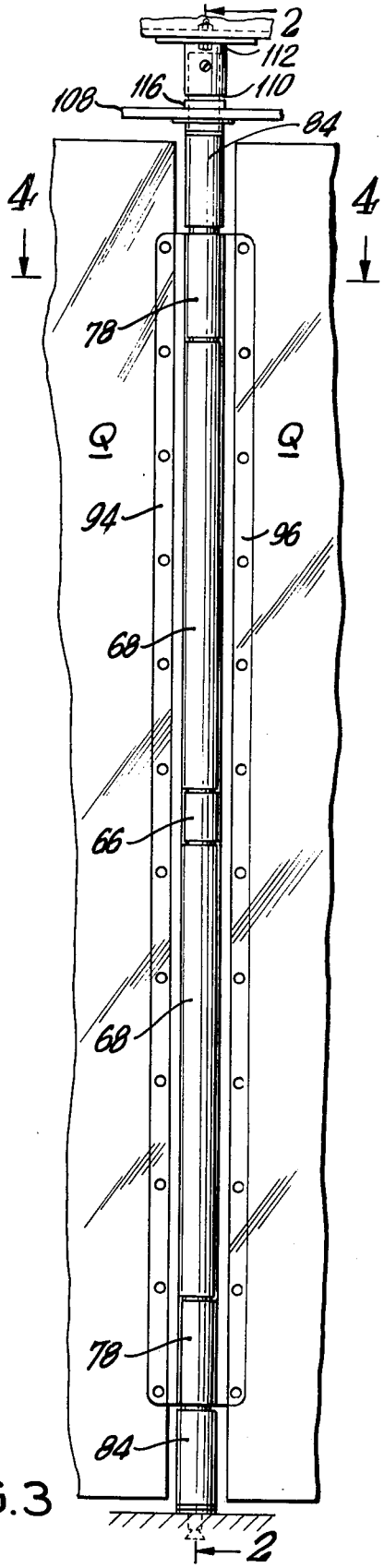
FIG. 3 is a fragmentary elevation view of a pole carrying two movable panels which form part of the partition.

FIGS. 2 and 3 illustrate a typical pole 60 which carries a pair of panels Q for rotation thereabout. Pole 60 is attached at its ends fixedly to the floor F and ceiling C. Pole 60 is adjustable in height and to this end includes an intermediate portion 62. Portion 62 includes a central cylindrical shaped block 64. Positioned concentrically thereon is a first sleeve hinge 66 and a pair of second sleeve 68. Sleeves 68 are pinned to block 44 as by pins 69 and a brass bushing 70 is located between each second sleeve and the first sleeve hinge. Sleeves 64 and 69 are conveniently fabricated from extruded aluminum or steel pipe of common size. Since sleeve 66 is a hinge, it is preferable to undercut block 64 in the area of the sleeve to produce a clearance 74 for ease of rotation. Each sleeve 68 has a second cylindrical block 76 pinned therein and extending therefrom. A rotatable sleeve 78 is positioned about the free end of block 76. A brass bushing 80 is interposed between the abutting ends of sleeves 78 and 68. The free ends of sleeves 78 in turn have an adjustment block 82 pinned therein and extending therefrom. A portion of each block 82 is threaded to engage the internal threads of an adjustment sleeve 84.

Adjustment sleeves 84 define an adjustment area 90 between the end thereof and the adjacent end of sleeves 82. The opposite ends of sleeves 84 bear against a bushing 92 which is supported from either the floor F or ceiling C.

Figure 4:
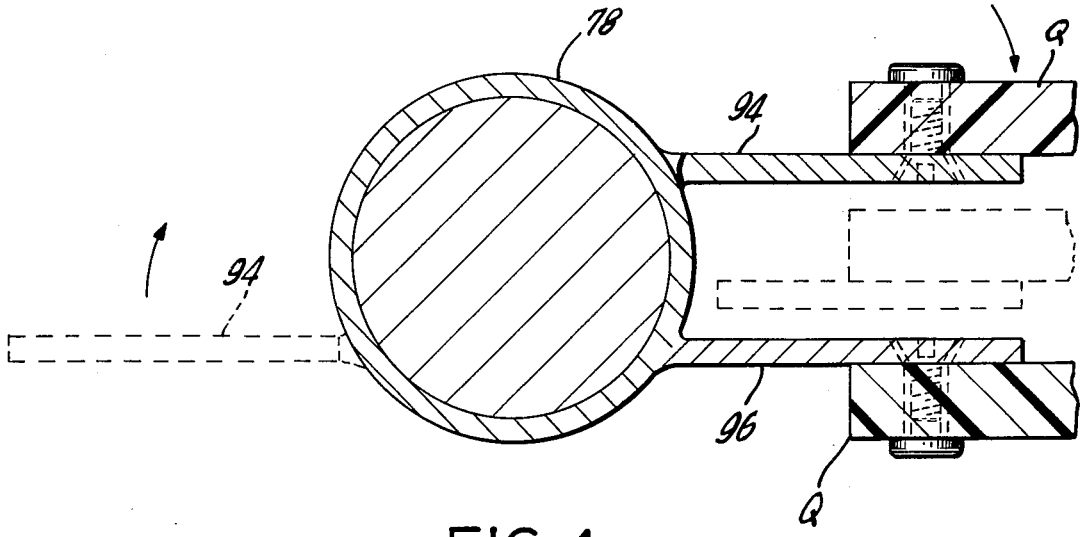
FIG. 4 is a cross-sectional view of a pole taken generally along line 4—4 in FIG. 3 and showing the panels in the folded or open position.
Figure 1A:
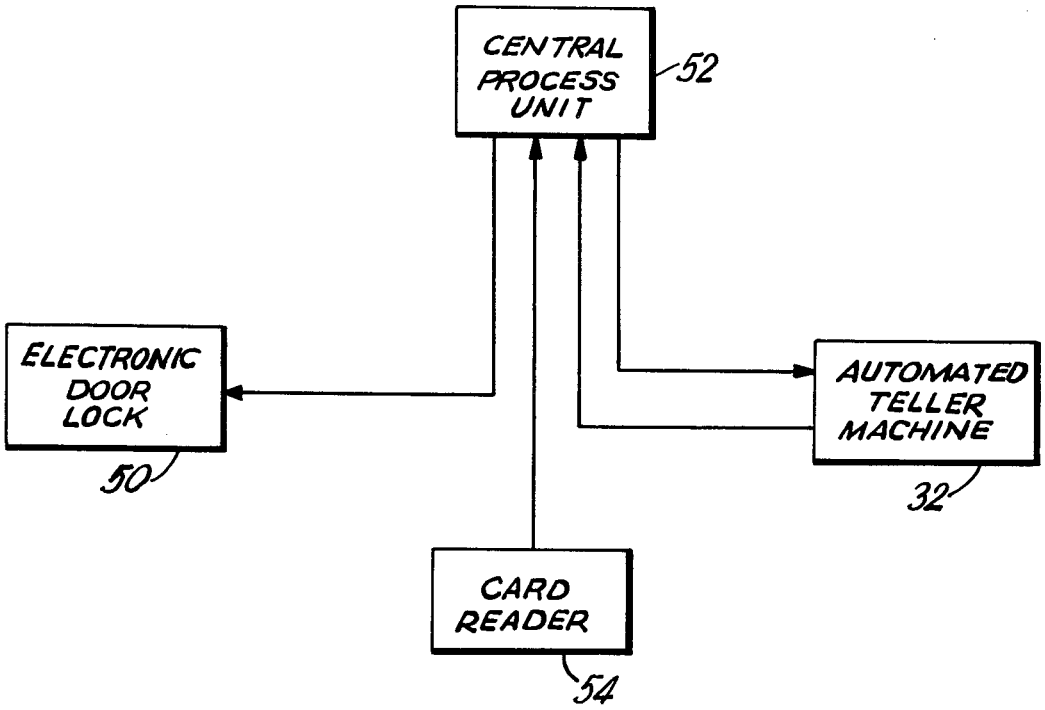
FIG. 1A is a block flow diagram illustrating an overall credit card system useful in the present invention.

Pole 60 is a double hinged panel pole which allows both panels to rotate. With particular reference to FIGS. 3 and 4, the panels Q are carried on flanges extending from the pole. The left hand panel, as viewed in FIG. 2, is riveted to flange 94 which is attached to sleeves 68. The right hand panel is riveted to flange 96 which is in turn attached to sleeves 68 and 78.

Figure 5:
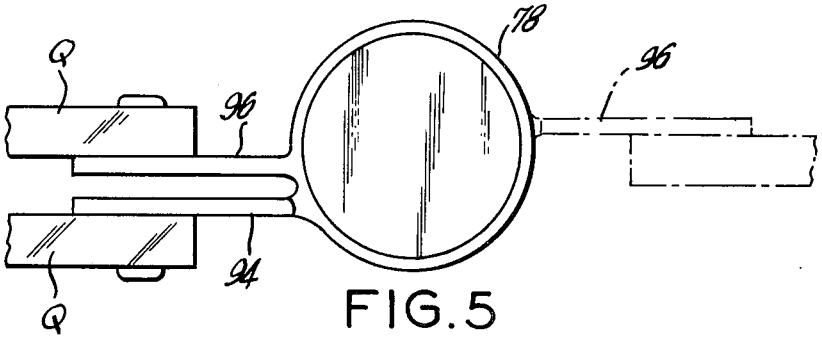
FIG. 5 is a cross-sectional view of a pole similar to FIG. 4 showing an alternative panel mounting configuration.
Figure 6:
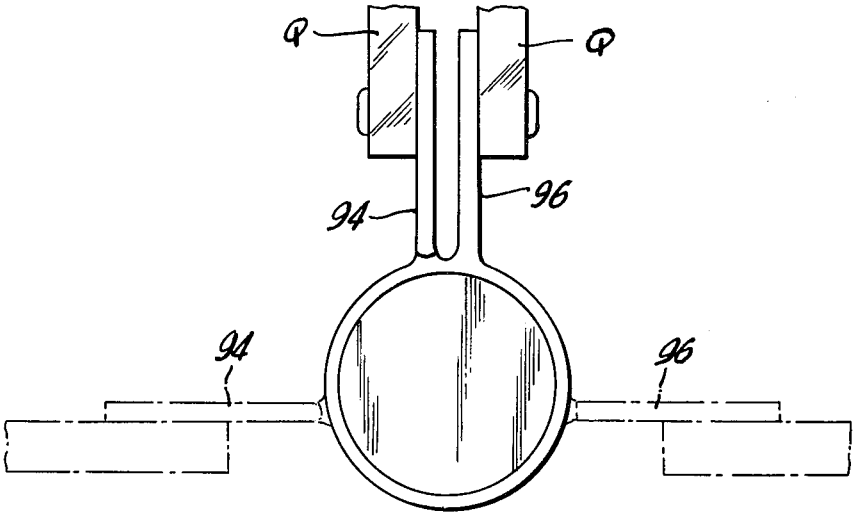
FIG. 6 is a cross-sectional view of a pole similar to FIG. 5 showing another panel mounting configuration.

Flanges 94 and 96 may be positioned in a variety of configurations relative to the centerline of the pole and each other. FIGS. 4 and 5 illustrate a flange configuration wherein one panel is rotated 180° and may receive an adjacent panel or not therebetween. FIG. 6 illustrates a flange configuration wherein both panels are rotated 90°.

ADjustment area 90 allows the panels to be raised and lowered to fit the installation characteristics. By rotating sleeves 84 a proper orientation is achieved while the system is supported from bushings 92.

Again referring to FIG. 2, the bottom bushing is supported from the floor F by a cylindrical mounting block 100 with a support flange 101. Block 100 is fixedly attached to floor F by expansion bolt 102.

The top bushing 92 is carried on a cylindrical block 106 which extends through the false ceiling 108. Block 106 carries a sleeve 110 which telescopes into a mounting sleeve fixture 112 affixed to ceiling C by fasteners 114. A finishing decorative bushing 116 may be inserted in the hole in the false ceiling to complete the assembly. The telescopic movement of sleeve 110 allows the panels to be raised or lowered. After the panels have been positioned in the proper orientation, sleeve 110 is pinned to fixture 112 by fastener 120. Similarly, sleeves 84 are pinned to blocks 82 by fasteners 122.

Figure 8:
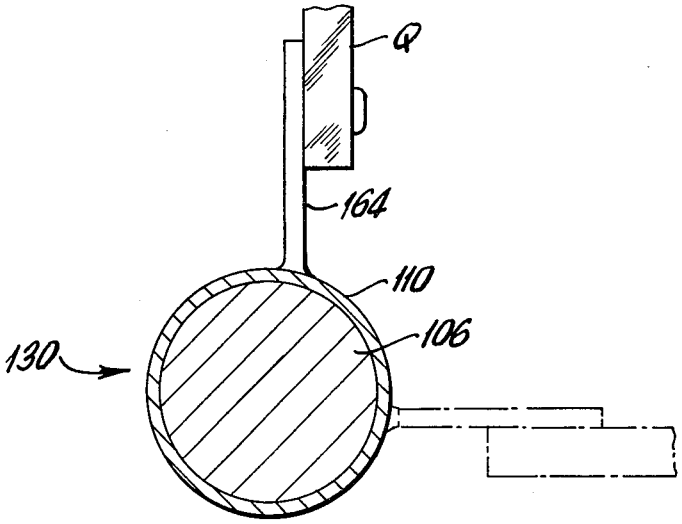
FIG. 8 is a cross-sectional view taken generally along line 8—8 in FIG. 7 and illustrating the panel in the open position.
Figure 7:
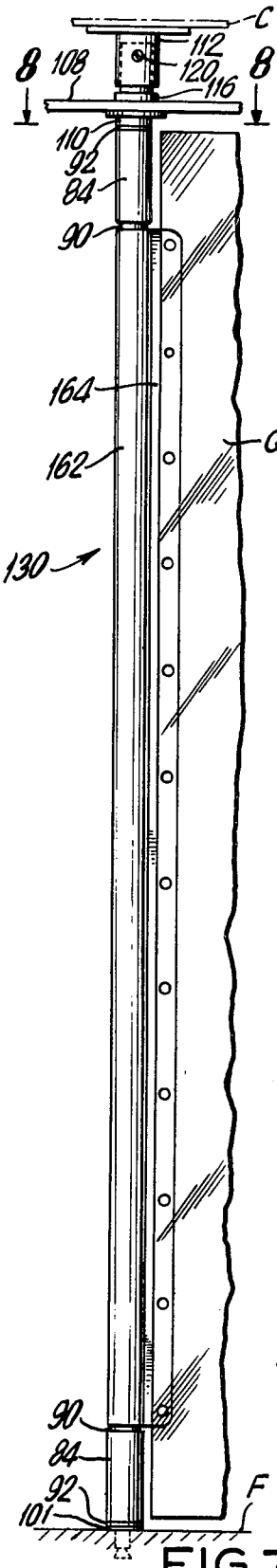
FIG. 7 is a fragmentary elevation view, taken generally in the direction indicated by arrows 7—7 in FIG. 1.

FIG. 7 illustrates another pole 130 which is similar to pole 60 just described, except that pole 130 carries a single panel Q. As best illustrated in FIGS. 1 and 8, pole 130 is designed for use adjacent a wall 24 so that the panel Q may be rotated to an open position so that the panel is essentially parallel to the wall.

Pole 130 contains many of the same components previously described in connection with pole 60. Accordingly, corresponding elements are designated with corresponding numerical designations and their description will not be repeated. The intermediate portion of pole 130 is formed by an extended sleeve 162 which has a flange 164 extending along its entire length for mounting panel Q. Sleeve 162 has an adjustment block 82 pinned in each end and interconnected to sleeves 84 as previously described. Thus, the sleeve assembly of the pole rotates about bushings 92 to allow panel Q to be moved between the open and closed positions.

The poles 60 and 130 described thus far are essentially hinges about which the panels Q are rotated. It will be clear that a means for locking the panels in the closed position is necessary and the next structures to be described are designed to provide the locking capability for the partition system.

Figure 9:
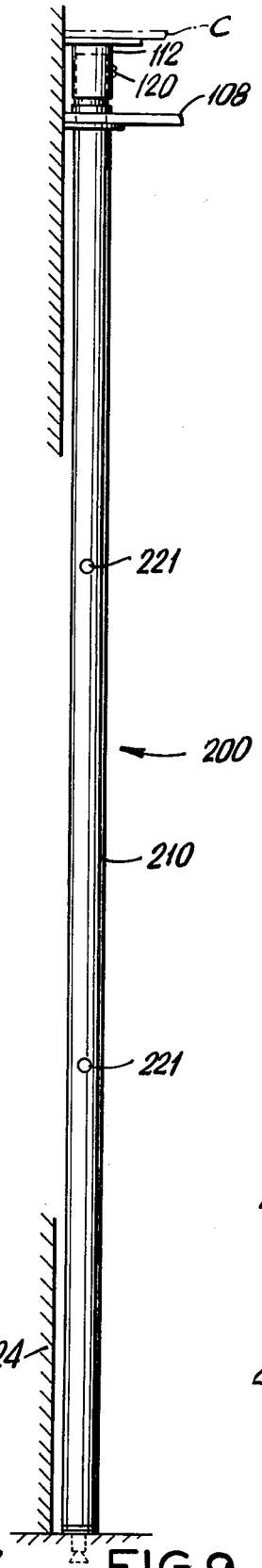
FIG. 9 is an elevation view taken generally in the direction indicated by arrows 9—9 in FIG. 1 illustrating a locking pole.
Figure 10:
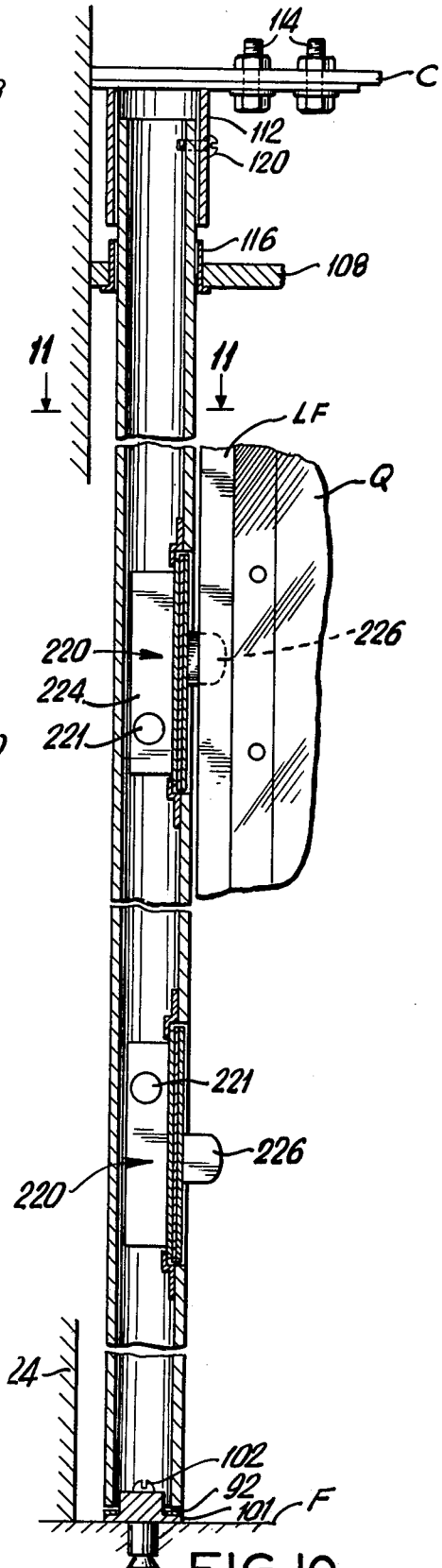
FIG. 10 is a fragmentary, enlarged, longitudinal, cross-sectional view of the locking pole of FIG. 9 with the locks in the extended position.
Figure 11:
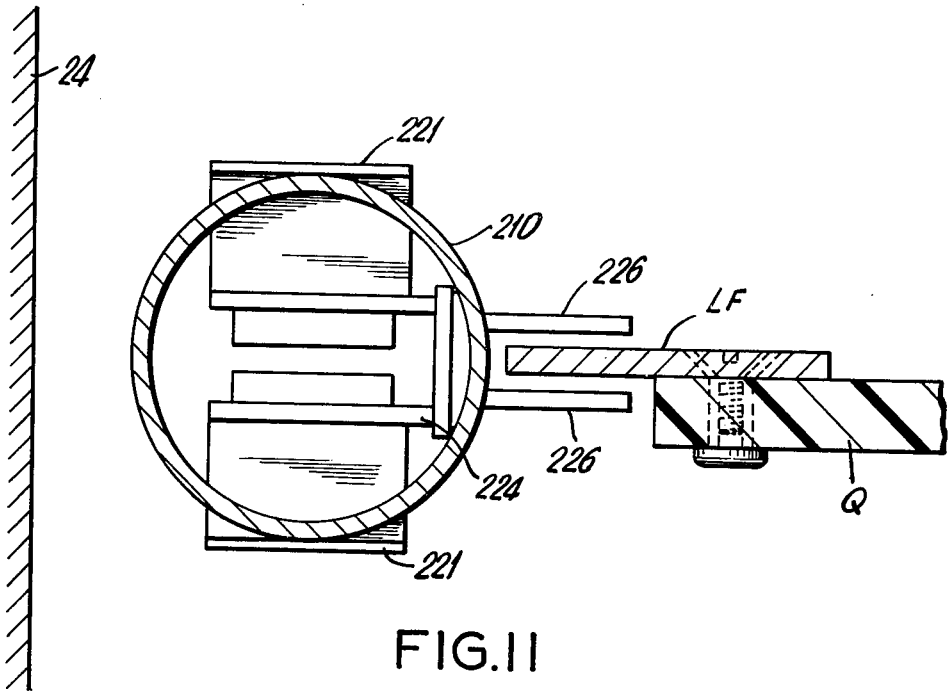
FIG. 11 is a cross-sectional view taken generally along line 11—11 in FIG. 10.

The pole 200 shown in FIGS. 9, 10 and 11 is a locking pole whose sole function is to lock a single panel Q in the closed position. Pole 200 is designed to be positioned adjacent an upright wall 24 and is attached to the floor F and ceiling C in a similar fashion to that described above. Pole 200 includes a single sleeve 210 which extends from the floor F to the ceiling fixture 112, where it is pinned by fastener 120. Sleeve 210 is thus fixed and non-rotatable.

The vertical edge of the free side of each panel is gripped by a locking mechanism 220 carried in pole 200. The panels Q illustrated are of a plastic material and include a metallic locking flange LF which is affixed to the vertical free edge and which is engaged by the locking mechanism 220.

Preferably, a pair of locking mechanisms 220 are provided in the pole 200 to provide greater support and security. Each locking mechanism 220 includes a lock cylinder 221 on each side so that the locks may be operated from either side of the partition, as by a key. The cylinders 221 operate a typical dead bolt locking mechanism 224 whose bolt 226 has been modified to form a fork or U-shaped position to receive locking flange LF therein. Suitable locking mechanisms are commercially available subject to the bolt modification described, e.g. Adams-Rite Model MS-1851A-628.

When the partition system is to be closed and locked, the adjacent panel Q is rotated into alignment with the locking pole 200 and the locking mechanism is operated to cause bolt 226 to project and grasp locking flange LF. Unlocking the partition system is simply the reverse procedure.

Figure 14:
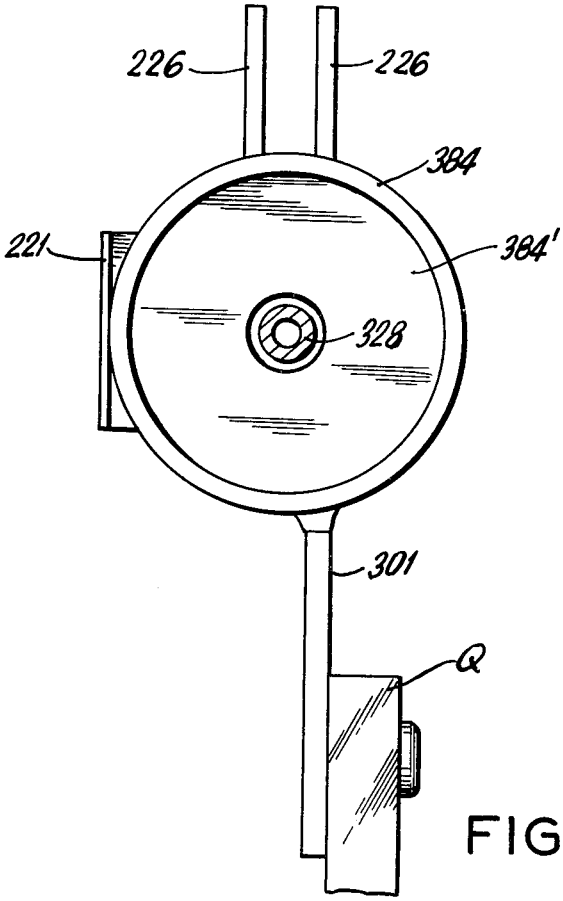
FIG. 14 is a cross-sectional view taken generally along line 14—14 in FIG. 13.
Figure 12:
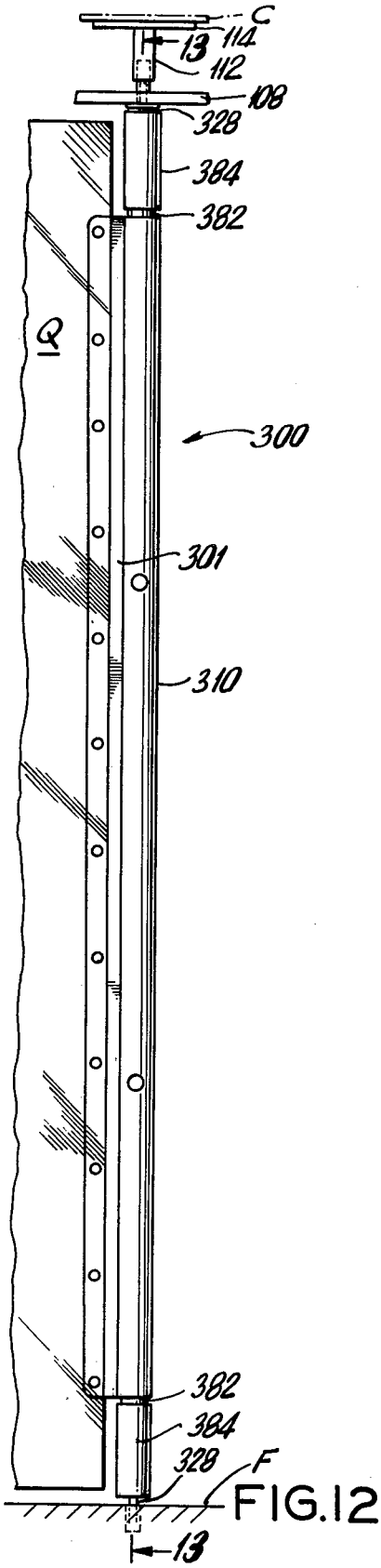
FIG. 12 is a fragmentary elevation view of a movable support pole with locks.
Figure 13:
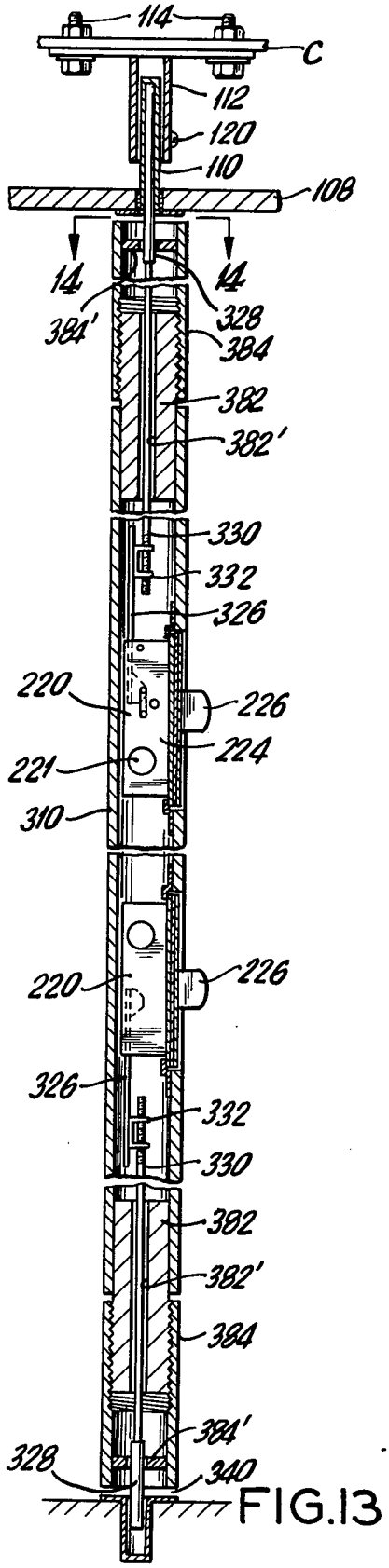
FIG. 13 is a cross-sectional view taken generally along line 13—13 in FIG. 12.

The pole assembly 300 shown in FIGS. 12, 13 and 14 is a still further modification in the locking pole wherein the pole 300 is carried on the free end of a panel Q. In other words the pole is affixed to panel Q by riveting its flange 301 to panel Q. Pole 300 has two features; namely, it may lock the panel on which it is affixed in the closed position and it may also lock the next adjacent panel.

To these ends, pole 300 includes an elongate sleeve 310 which is integral with flange 301. In each end of sleeve 310 is pinned a cylinder block 382. Blocks 382 correspond to blocks 82 except that a central bore 382' is provided to receive a drop bolt, described below. Block 382 threadably engages sleeve 384. Sleeve 384 is similar to sleeve 84 except that an annular dead bolt guide 384' is present at the interior thereof.

Sleeve 310 also includes a pair of locking mechanisms 220 of the type described above so that an adjacent panel may be locked in bolts 226. Each locking mechanism 220 also includes a drop bolt adapter 326 which is commercially available. Each adapter 326 is moved vertically during the operation of lock cylinder 221 to lock and unlock a drop bolt 328. Each bolt 328 is carried at the end of a threaded rod 330 which is threaded at its opposite end to a U-shaped weldment 332 on adapter 326. Rods 330 and bolts 328 are axially aligned in the center of sleeve 310 and are inserted into receivers in the floor and ceiling to lock the pole in position and removed therefrom to allow the pole to be rotated with its associated panel. The ceiling receiver is provided by sleeve 110 and the floor receiver 340 is a sleeve element having a floor mounted flange.

These and other modifications may be made to the present invention without departing from the scope and spirit thereof as pointed out in the appended claims. It will be clear to those skilled in the art that various arrangements of the poles 60, 130, 200 and 300 may be used to achieve the partition of the bank.

What is claimed is:

1. An adjustable pole and moveable panel assembly for erection between a pair of parallel surfaces comprising: a longitudinally extending intermediate section having an externally threaded portion at each end thereof; means at each end of said intermediate section for attaching the intermediate section to a pair of parallel surfaces, each mounting means including a rotatable and longitudinally moveable tubular portion having a threaded interior at one end, said tubular portion being threadably engaged with said intermediate section threaded portions, whereby the length of said assembly may be adjusted by rotating said mounting means relative to said intermediate section; said intermediate section being comprised of a centrally located first cylindrically shaped block having a first, rotatable, cylindrical sleeve concentrically mounted thereon, a pair of second cylindrical sleeves concentrically attached to said central block, on each side of said first sleeve, each of said second sleeves having a second cylindrical block attached thereto and extending longitudinally therefrom; a pair of third cylindrical sleeves concentrically and rotatably mounted on said associated second cylindrical block; each of third cylindrical sleeves having a third cylindrical block extending from the free end thereof, said third cylindrical block being threaded to provide said intermediate section threaded portions; a pair of partition panels, means mounting one of said panels to said first and third sleeves and means mounting the other panel to said second sleeves, whereby said panels may be rotated independently about said pole assembly and supported thereby.

2. A pole assembly of claim 1, wherein said attaching means includes means for fixedly positioning the ends of said assembly.

3. A pole assembly of claim 1, wherein said attaching means includes means adapted and arranged to detach the ends of said assembly from the parallel surfaces.

* * * * *